United States Patent [19]

Cook

[11] 4,453,339

[45] Jun. 12, 1984

[54] MUSICAL RAIL ROCKER

[75] Inventor: John S. Cook, Redondo Beach, Calif.

[73] Assignee: Mattel, Inc., Hawthorne, Calif.

[21] Appl. No.: 417,317

[22] Filed: Sep. 13, 1982

[51] Int. Cl.[3] ..... A63H 5/00; A63H 13/18

[52] U.S. Cl. ..... 446/227; 446/298

[58] Field of Search ..... 46/123, 147, 175 R, 46/115, 116, 118; 272/53.1, 53.2, 52.5, 52

[56] References Cited

U.S. PATENT DOCUMENTS

| | | | |
|---|---|---|---|
| 621,061 | 3/1883 | Gay . | |
| 2,519,782 | 8/1950 | Mueller et al. | 84/95 |
| 2,550,991 | 5/1951 | Goodman et al. | 84/95 |
| 2,599,948 | 6/1952 | Shvetz | 84/95 |
| 2,630,040 | 3/1953 | Fraysur | 84/102 |
| 2,769,988 | 11/1956 | Bukolt | 5/317 |
| 2,847,891 | 8/1958 | Scott | 84/94 |
| 2,928,674 | 3/1960 | Foster, Sr. | 272/53.2 |
| 2,930,272 | 3/1960 | Vogt | 84/95 |
| 3,008,267 | 11/1961 | Schneider | 46/147 |
| 3,060,628 | 10/1962 | Palmer | 46/32 |
| 3,395,599 | 8/1968 | Villiger | 84/95 |
| 3,786,596 | 1/1974 | Breslow et al. | 46/98 |
| 4,285,159 | 8/1981 | Bass et al. | 46/262 |

*Primary Examiner*—F. Barry Shay

*Attorney, Agent, or Firm*—Roy A. Ekstrand; Ron M. Goldman; James G. O'Neill

[57] ABSTRACT

A crib toy in the shape of a rocking pony having an outer shell with a downwardly facing U-shaped aperture contained therein. The U-shaped aperture contains a clamp adapted to fit over different sized crib rails to securely clamp the pony thereto. The shell contains a mechanism having an output shaft which drives a gear train for rocking the pony through a slideable connecting means, while music is also played by the mechanism.

10 Claims, 9 Drawing Figures

Fig.4.
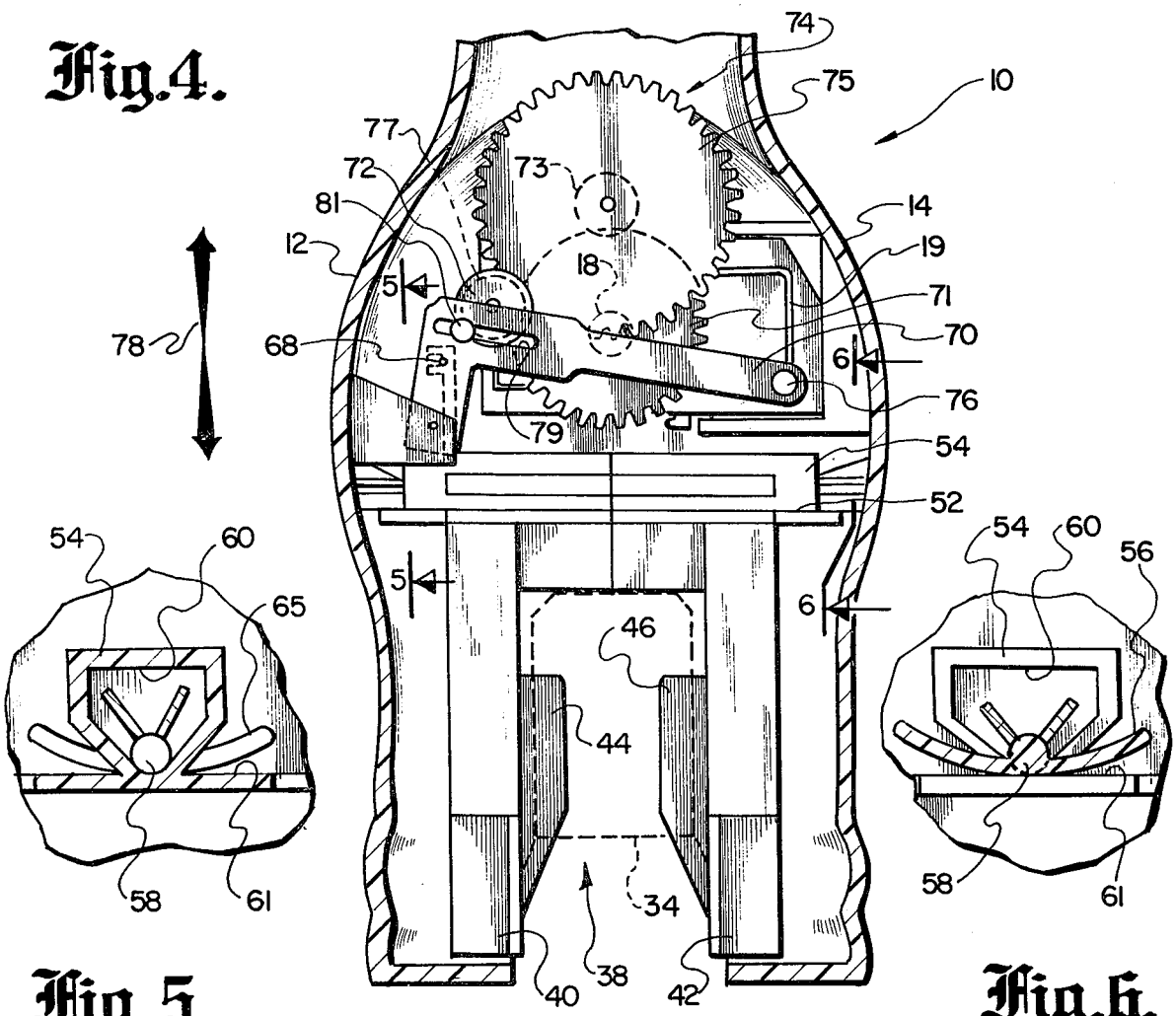
Fig.5.
Fig.6.
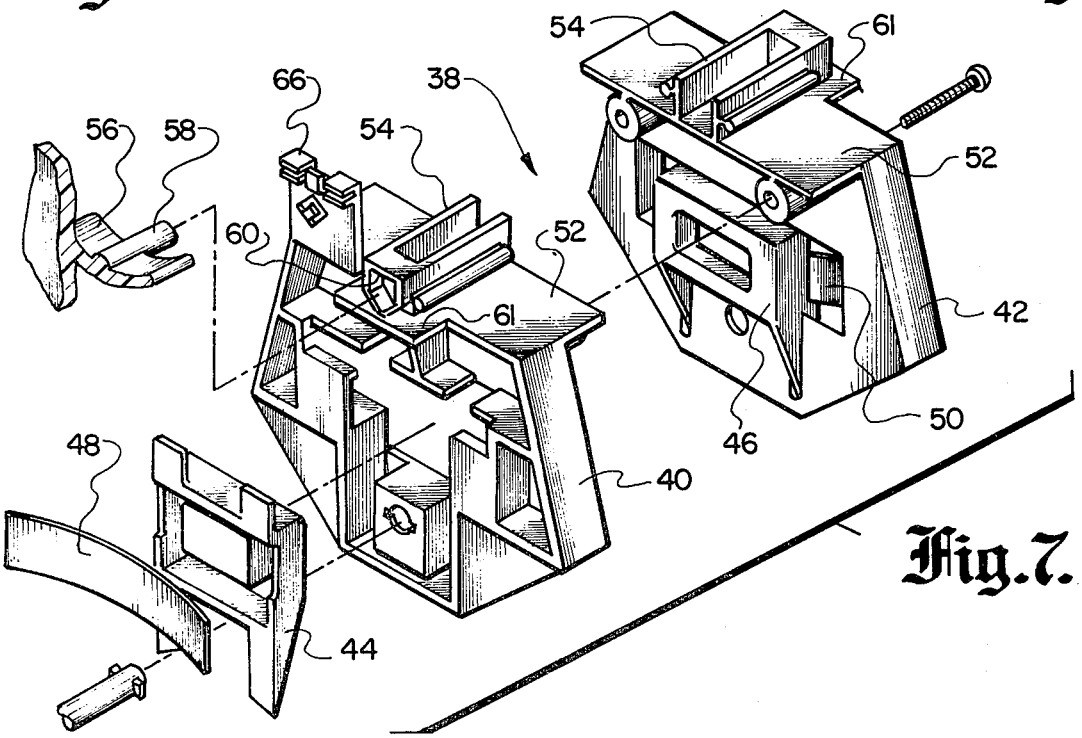
Fig.7.

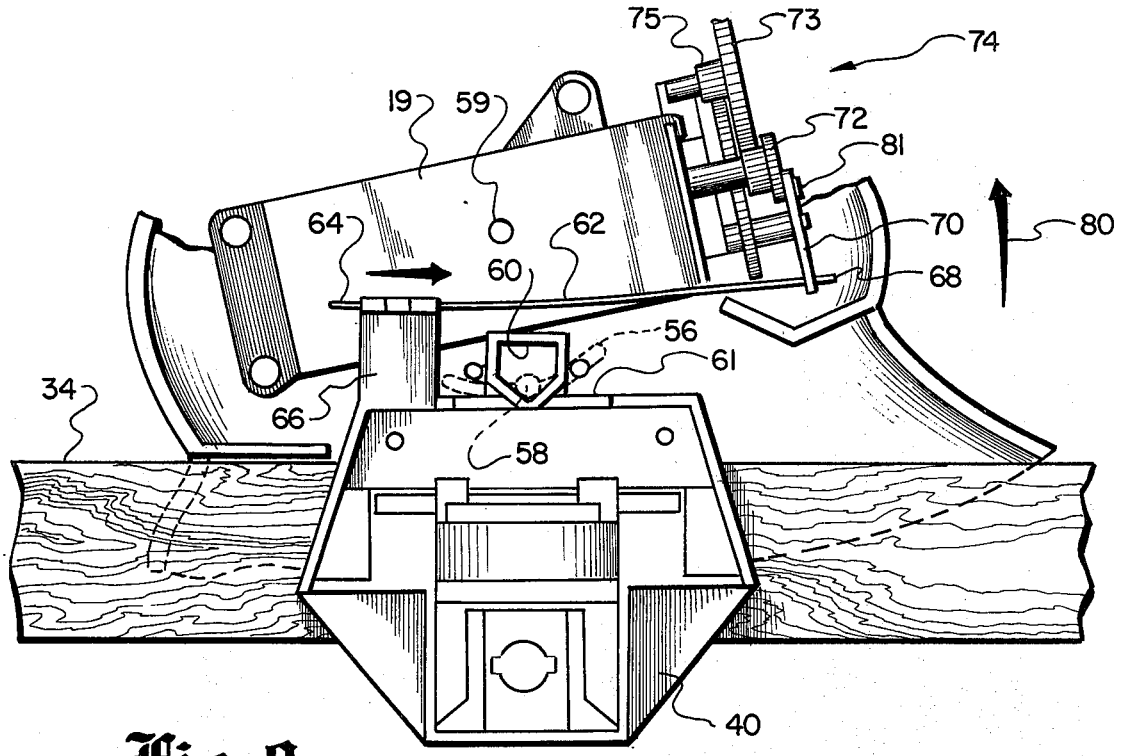
Fig. 8.
Fig. 9.
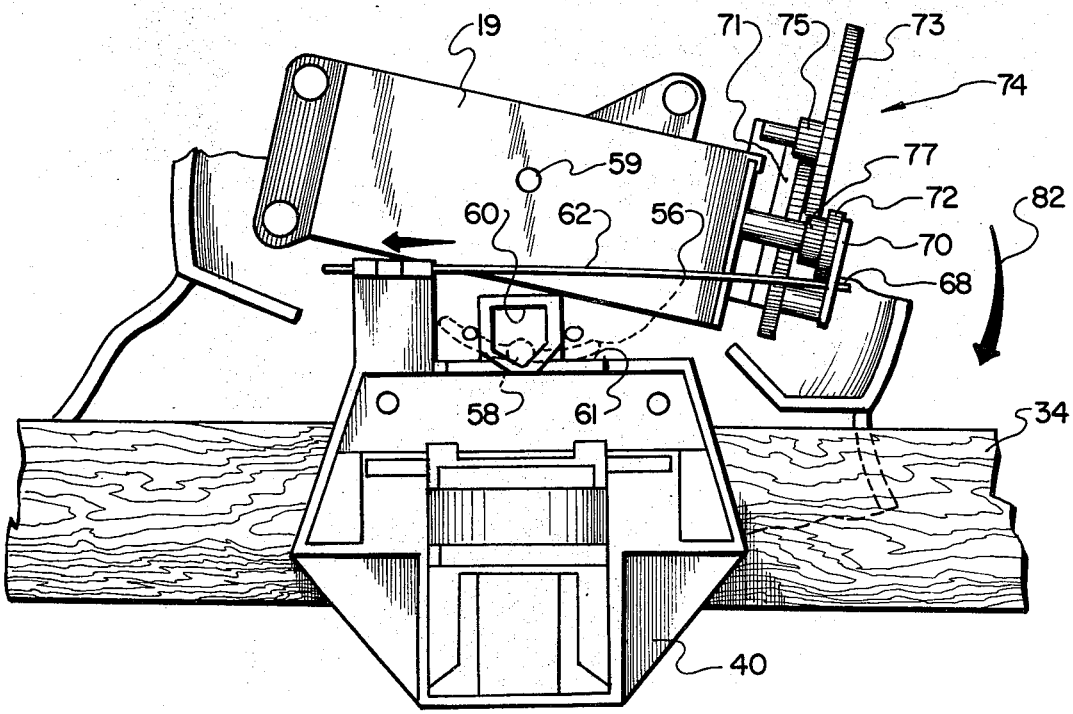

MUSICAL RAIL ROCKER

BACKGROUND OF THE INVENTION

This invention relates generally to crib toys and more particularly to a mechanized crib toy adapted to rock on the rail of a crib.

There are many known crib toys for amusing and entertaining a child. Many of these toys include musical devices which are mechanically actuated in any number of different ways. An example of such a device is shown in U.S. Pat. No. 4,285,159, issued Aug. 28, 1981, which discloses a RAIL RUNNER (trademark of Mattel, Inc.) toy train containing a music box adapted to move the train back and forth along a crib rail.

None of the above mentioned prior art devices discloses a mechanized crib toy having a music box adapted to rock the toy on the rail of a crib.

SUMMARY OF THE INVENTION

The present invention relates to a crib toy having an hollow outer shell with a mechanism including a spring-wound music box contained internally thereof. The output shaft of the mechanism is connected through a suitable gearing arrangement and a sliding coupling means to a clamp for mounting the entire toy on a crib rail. Therefore, when the motor of the mechanism is actuated, music will be played and the toy will be rocked. The gear ratio of the gearing arrangement is specifically designed and coordinated with turning of the output shaft to rock the toy, through the sliding coupling means, at a predetermined frequency. In a preferred embodiment of the invention, the hollow outer shell, is molded in the shape of a pony or rocking horse.

BRIEF DESCRIPTION OF THE DRAWINGS

Reference is now made to the accompanying drawings wherein:

FIG. 3 is a sectional view taken along line 3—3 of FIG. 2;

FIG. 4 is a sectional view taken along line 4—4 of FIG. 3;

FIGS. 5 and 6 are enlarged partial sectional views taken along lines 5—5 and 6—6 of FIG. 4, respectively, showing the short rockers and centering pins;

FIG. 7 is an exploded perspective view showing the clamping means for mounting the crib toy of the present invention on a rail;

FIG. 8 is a partial sectional view showing the music box and the crib toy in an upward rocking position; and FIG. 9 is a partial sectional view similar to that shown in FIG. 8 with the music box and the crib toy in a different or downward rocking position.

DESCRIPTION OF THE PREFERRED EMBODIMENT

Figure 1:
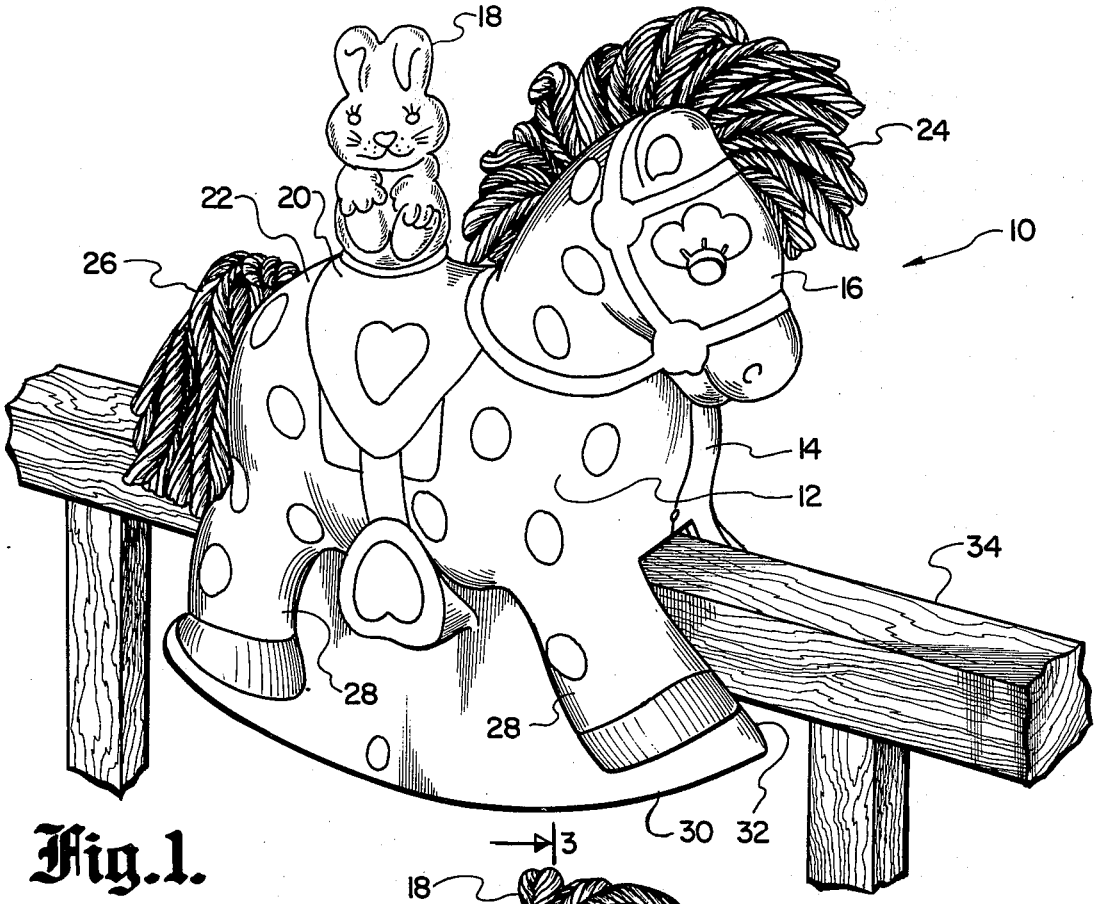
FIG. 1 is a perspective view of the crib toy of the present invention mounted on the rail of a baby's crib.
Figure 2:
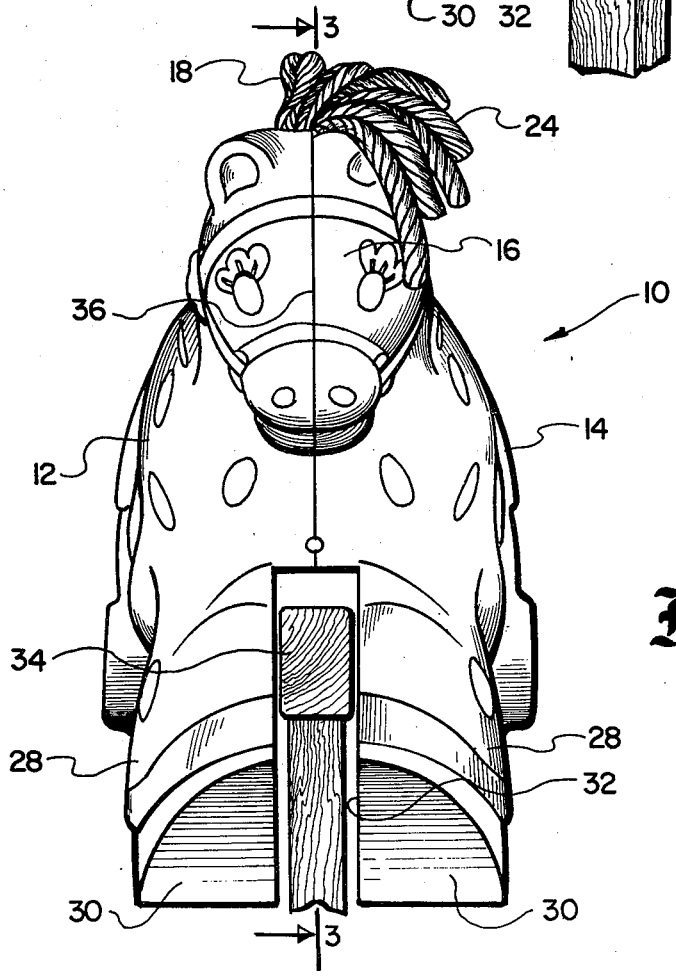
FIG. 2 is a front plan view of the crib toy of FIG. 1.
Figure 1:
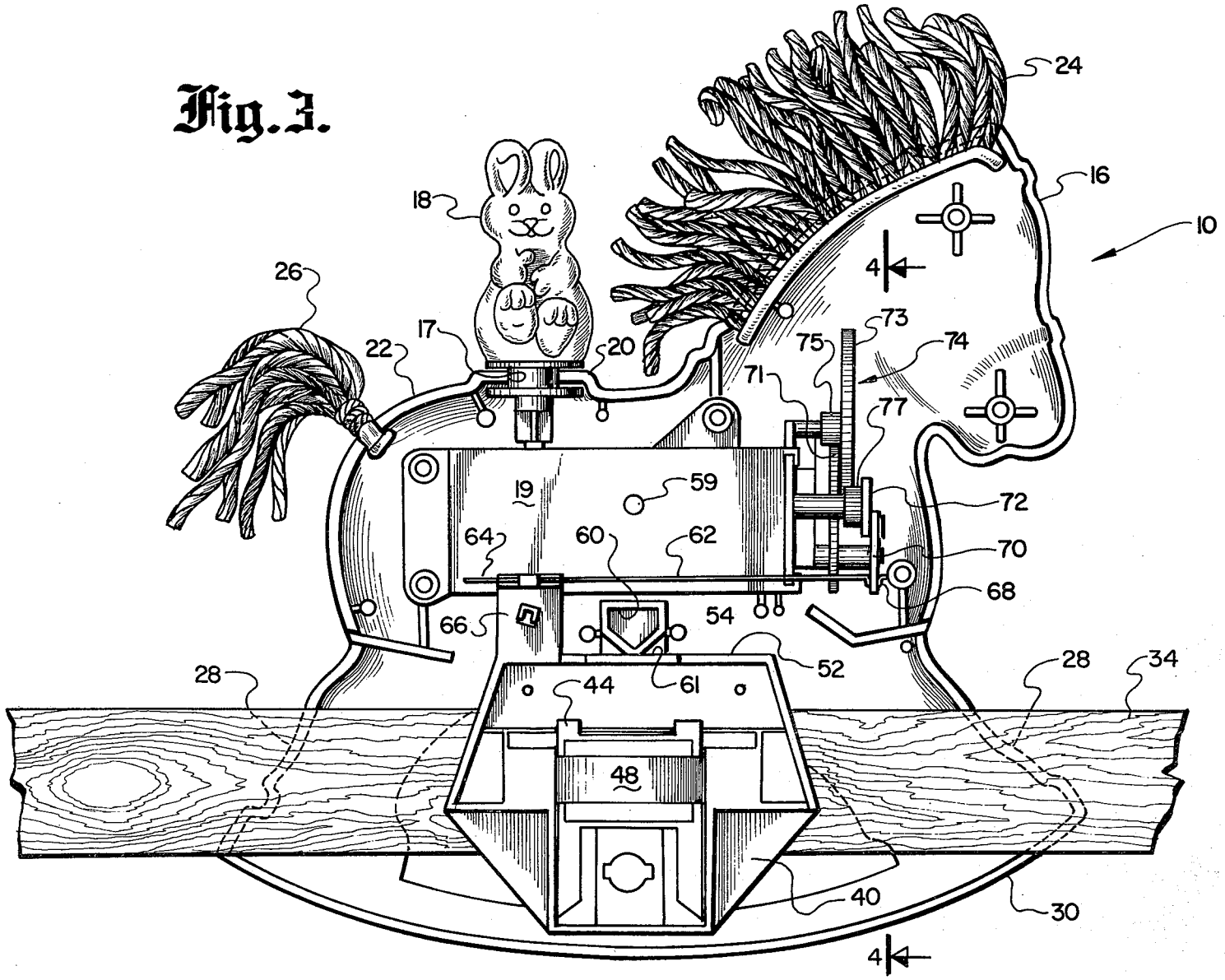

Referring now to the attached drawings in which like reference numerals refer to like elements throughout the several views, there shown is the shell 10 of a child's toy. The shell may be molded out of any suitable material to emulate any desired object and is preferably in the form of a pony or rocking horse. The shell 10 may be one piece, or contain a left housing 12 and a right housing 14, as viewed in FIG. 2 of the drawings. As shown in FIGS. 1 and 3, the pony includes a head 16 at the right end thereof. A winding element or key 18, preferably in the form of a bunny rider, is mounted to the left of the head 16. The bunny passes through hole 17 formed in a simulated saddle 20 carried on the back 22 of the pony. The pony also includes a simulated mane 24 and tail 26 held in a known manner between the two halves 12 and 14.

The bunny 18 is adapted to wind up or rotate a spring motor (not shown) held within a housing 19 which also contains a musical mechanism adapted to play a lullaby or tune, in a manner well known in the art. In turn, the musical mechanism is adapted to rock the pony, as described more fully hereinafter. The two halves 12 and 14 of the pony are preferably molded with depending legs 28 having rockers 30 with a downwardly facing U-shaped channel 32 formed therebetween. The U-shaped channel allows the pony to be placed in position upon any type of thin wall member 34, such as a crib rail or the like. If the shell has two halves, they are joined together along a seam 36, as is well known in the art. In addition, the rockers 30 allow the pony to be used as a floor toy.

As is shown more clearly in FIGS. 3 through 9 of the drawings, a clamp 38 having two halves 40, 42 is used for securely holding the rocking horse to various size rails. The clamp includes spring biased holding members 44, 46 resiliently held against the sides of various sized rails by means of leaf springs 48, 50 formed as arc or triangular shaped members (see FIG. 7).

With the two halves 40, 42 of the clamp 38 joined together, an upper planar surface 52 is formed having an integral centering block 54. As is clearly shown in FIGS. 5 and 6, each of the right and left housings 12 and 14 is provided with a short rocker 56 and a centering pin 58 on the interior surface thereof. The short rockers 56 are designed with a radius which allows the pony to rock at a predetermined frequency or period. In addition, the short rockers 56 always allow the pony to return smoothly to the central rest position, as shown in FIGS. 1–5 of the drawings, if not mechanically rocked, as explained more fully below. The radius of the short rockers 56 is measured from the center of gravity of the pony, marked with a circle 59, shown in FIGS. 3, 8 and 9.

With the shell of the pony mounted over the clamp 38, the centering pins 58 on each side of the shell, engage in openings 60 formed at each end of the centering block 54. The short rockers 56 rest on the top surface of lips 61 preferably formed integral with and extending from planar surface 52. In this manner, the pony 10 may be rocked on short rockers 56 acting against the top surface of lips 61.

As shown in FIGS. 3, 8 and 9, a wire 62 having an end 64 slidingly coupled to clamp 38 through means of a vertically extending tab 66 formed integrally with clamp half 40 is used to mechanically rock the pony. The other end 68 of wire 62 is securely connected to a link 70 driven by a crank or eccentric 72. The eccentric is turned by a gear train 74 driven by an output shaft 18, shown in phanton line in FIG. 4, extending from within the housing 19. The ouput shaft is turned by the spring driven motor and the music box assembly in a manner similar to that disclosed in U.S. Pat. No. 4,285,159, the description of which operation is incorporated herein by reference.

Gear train 74 includes a gear 71 attached to the output shaft 18. Gear 71 drives a larger gear 75 through a spur gear 73 joined coaxially therewith. Gear 75 drives the crank or eccentric 72 through a coaxially formed spur gear 77. The size of and number of teeth on the individual gears 71, 73, 75, and 77 varies, depending on the speed of the output shaft, the radius of the short rockers 56, and the frequency or rate at which it is desired to rock the pony when mounted on a rail.

The overall gear ratio of the gear train 74 is coordinated to the speed of the output shaft and the radius of the short rockers to allow the pony to be rocked at what may be termed its "resonant frequency". In other words, the pony will be continuously rocked at a fairly constant rate, which rate is approximately the same as the speed of rotation of the entire gear train 74. In the preferred embodiment, the radius of each of the short rockers 56 is chosen to allow the pony to rock at one cycle per second, i.e., the same frequency as the speed of rotation of the gear train.

In operation, after the bunny 18 is turned to wind the spring motor within the housing, the spring motor will commence operation to play the music box melody. The music box mechanism will also turn the output shaft 18 thereby driving the gear train 74 at its predetermined speed. The gear train will drive the crank or eccentric 72 to move link 70. Because the link is connected or fixed at one end 76 to the housing 19, and includes a slot 79, a pin 81 of the crank 72 will drive the link in an oscillating, upward and downward motion, as shown by the arrow 78 in FIG. 4 of the drawings. As the gear train rotates, the crank or eccentric 72 will be moved downwardly thereby driving the link 70 downwardly. The link 70 will in turn drive the end 68 of wire 62 downwardly and allow it to move in the downward direction, to thereby force the pony to rock upwardly on rockers 56, as shown by arrow 80 in FIG. 8 of the drawings. End 64 of wire 62 will slide within tab 66. When the link moves upwardly, the end 68 of the wire 62 will have pressure released therefrom and end 64 will slide to the rear, to thereby allow the pony to rock downwardly on short rockers 56 in the direction of the arrow 82, shown in FIG. 9 of the drawings. In this manner, it can be seen that the pony will rock, but will slow down due to friction. However, as the music box continues to play, the gear train will continuously apply a push through wire 62 to the rocking pony in a predetermined frequency along with the melody. This push will rock the pony and amuse a child watching the rocking pony mounted on a rail or the like.

The mechanical rocking movement of the pony may be envisioned as somewhat akin to the pushing of a child on a swing. As the pony is rocking back toward its central rest position, much like a swing with a child in it being given a push before the swing reaches the natural end of its backswing, the rocking pony receives a small push or jolt from the link and wire. This small push or jolt assists the continuous rocking motion without forcing it too much.

Thus, though there has been shown and described a preferred embodiment of the invention, other embodiments and configurations will be obvious to those skilled in the art without departing from the spirit and scope of the invention.

What is claimed is:

1. A crib toy comprising:

an outer shell adapted to be removably mounted on a crib rail;

means mounted within said shell for producing a melody, said means producing a melody including a motor having an output shaft;

means mounted to said toy for fixing said shell to said crib rail;

drive means mounted within said shell for rocking the toy with respect to said crib rail;

means for connecting said drive means to said output shaft; and short rockers held within said shell for assisting rocking of said toy.

2. A crib toy comprising:

an outer shell;

means mounted within said shell for producing a melody, said means producing a melody including a motor having an output shaft;

drive means mounted within said shell for rocking the toy on a crib rail, said drive means for rocking the toy including a gear train which drives an eccentric slidingly connected to a linkage means;

means for connecting said drive means to said output shaft;

short rockers held within said shell for assisting rocking of said toy; and means mounted to said toy for fixing said toy to said rail including a clamp, said linkage means being connected to said clamp by means of a wire slidingly coupled to said clamp at one end thereof and with the other end fixedly connected to said link.

3. The crib toy of claim 2 in which the gear ratio of said gear train is coordinated to the natural rocking period of said toy and the movement of said linkage means whereby said crib toy may be continuously rocked without forcing the same.

4. The crib toy of claim 2 wherein said clamp is self-adjusting so as to fit on various width rails.

5. The crib toy of claim 2 wherein said shell includes centering pins adjacent said short rockers; and a clamping means for fixing said toy to said rail held within said shell between said centering pins with said short rockers resting on a top surface formed on said clamp.

6. The crib toy of claim 5 wherein said drive means includes a gear train which turns an eccentric slidingly connected to a linkage means; a wire having two ends connected at one end to said linkage means and by said other end to said clamping means.

7. The crib toy of claim 6 wherein said end of said wire connected to said clamp is slidingly held in a tab extending from said clamp, whereby when said music box is operated, said drive means rocks said crib toy.

8. A crib toy comprising an outer shell, means producing a melody contained within said shell, said means producing a melody including a motor having an output shaft connected to drive means for rocking the toy on a crib rail, said rocking of said toy being assisted by short rockers held within said shell;

said drive means for rocking the toy including a gear train which drives an eccentric connected to a linkage means, the gear ratio of said gear train being coordinated to the natural rocking period of said toy;

a self-adjusting clamp fixing said toy to said rail, said clamp having a top surface;

said linkage means being connected to said clamp by means of a wire having two ends, one of said ends slidingly coupled to a tab formed in said clamp with the other end fixedly connected to said linkage means; and centering pins formed in said outer shell adjacent said rockers with said clamp held in said outer shell between said centering pins and with said short rockers resting on said top surface, whereby said toy may be rocked on said top surface by the action of said short rockers, aided by the movement of said linkage means.

9. In combination with a crib toy including an outer shell adapted to be removably mounted on a crib rail and a motor mounted to said shell, said motor having an output shaft, the improvement which comprises:

means mounted to said shell for connecting said shell to said crib rail in a rocking mode with respect to said crib rail, said connecting means cooperating with means on said shell comprising at least one rocker; and means coupling said shell to said motor output shaft for driving said shell in said rocking mode.

10. The crib toy of claim 9 wherein said means mounted to said shell for connecting said shell to said crib rail is a clamp which automatically adjusts said crib toy to fit different sized rails.

* * * * *